United States Patent [19]

Rattner

[11] Patent Number: 4,677,761

[45] Date of Patent: Jul. 7, 1987

[54] SIEVE DRUM

[76] Inventor: David Rattner, Box 104, Solebury, Pa. 18963

[21] Appl. No.: 828,890

[22] Filed: Feb. 13, 1986

[51] Int. Cl.[4] ..... F26B 25/20

[52] U.S. Cl. ..... 34/108; 34/110; 34/115

[58] Field of Search ..... 34/115, 123, 158, 155, 34/108, 110

[56] References Cited

U.S. PATENT DOCUMENTS

| | | | |
|---|---|---|---|
| 3,605,280 | 9/1971 | Fleissner | 34/158 |
| 3,893,246 | 7/1975 | Fleissner | 34/158 |
| 4,251,927 | 2/1981 | Luthi | 34/115 |
| 4,251,928 | 2/1981 | Rotar et al. | 34/123 |

*Primary Examiner*—Larry I. Schwartz

*Attorney, Agent, or Firm*—Robert J. Mooney

[57] ABSTRACT

A sieve drum is disclosed that is particularly useful in textile processing equipment, such as a suction drum dryer, for heat-treating of continuous web material. The sieve drum is constructed having a single layer of a close mesh screen cylindrically formed between a pair of end heads to provide support for and transmit torque to web material being processed. The close mesh screen is composed of a plurality of longitudinal and transverse wire lengths of relatively heavy gauge than are sinusoidally woven into a lattice having a multitude of small interstitial openings each with rounded edges to provide smooth, unabrasive support to the web material. The multitude of small openings the aggregate area of which comprises less than 50% of the screen surface provides an even distribution of heated air over the surface of the drum and exposes a high percentage of the supported web to the air from a fast, energy efficient heat-treating process.

12 Claims, 5 Drawing Figures

SIEVE DRUM

BACKGROUND OF THE INVENTION

The present invention relates to industrial processing equipment generally used in the textile industry for the continuous processing of elongated sheets of textile material and more particularly to an improved sieve drum constructed having a single cylindrical layer of a close mesh screen which provides more effective heat treatment of the textile material supported thereon.

Sieve drums are well known in the textile industry where they are employed, usually in tandem, to dry elongated webs of woven or knitted fabrics. Such dryer drums which are generally mounted within an insulated housing are supported for rotation about their axes and comprise substantially impervious end plates connected by a perforated cylindrical surface. A fan mounted in or ducted to one of the end plates operates to create a partial vacuum within the interior of the drum causing air to be drawn therefrom, circulated through a separate heater unit, and drawn back as heated air into the drum through the air-permeable web supported on its perforated cylindrical surface. The web is typically passed over opposing sectors of two tandem drums in a serpentine fashion so that both sides of the web may be directly exposed to the heated air. A stationary baffle provided within each sieve drum blocks the holes in the portion of the perforated surface not covered with the web to ensure that the suction draft of heated air is directed through the web.

The perforated cylindrical surface of known sieve drums have commonly been constructed of a relatively thin metal punctuated with squared, sharply edged holes. This relatively rigid drum surface both supports the web to be dried and transmits torque from one end plate to the other. While such perforated metallic cylinders have produced generally satisfactory drying results, the partial vacuum created within the drums, particularly in higher capacity systems, has caused portions of the web to be partly drawn into the holes as the web passes over the perforated surface creating permanent dimples or puckers in certain types of web materials. In addition, a somewhat similar pattern of drying appears in web materials supported upon these perforated cylinders due to the greater amount of heat being transferred to the web material lying directly over the holes. Such a dotted pattern of heating can be particularly adverse for certain resins, dyestuffs and chemicals commonly used in processing of textile webs.

To resolve these problems of marked impressions and uneven heating of the web materials, it became well known to cover the perforated metallic cylinder with a fine wire mesh which was generally wrapped around the cylinder between the end plates and abutted together by a soldered joint extending along the surface. While such a wire mesh cover overtop the perforated cylinder eliminated much of the undesirable web impressions, there continued to be some surface markings of the web caused by unevenness of the soldered joint in the abutment area. Also, while the degree of uneven, patterned heating showed improvement, there became evident a reduction in air permeability in the joint abutment area that adversely affected drying effectiveness.

An inherent limitation of the perforated cylinder type of sieve drum that remains unaffected by any incorporation of a wire mesh cover is particularly evident when the web materials being heat treated have been treated with resins, dyestuffs and other similar chemicals. Over time, some of the resins are inevitably drawn into the sharply edged, circular holes of the perforated cylinder reducing the effective diameter of the holes and often obstructing them completely. As more and more holes are so obstructed, less and less of the web material is subjected to the suction draft of heated air resulting in ineffective and uneven drying. While certain suction drum designs have been proposed absent the perforated cylinder and having a wire mesh jacket internally supported and secured between opposing end plates, the additional supporting structure required within such suction drums has interfered with the structure and effective operation of the blocking baffles which must be set in close proximity to the interior surface of the drum to function effectively. In addition, existing designs of wire mesh drums have had relatively large mesh openings which adversely affect uniformity of suction draft pressure across the surface length of the drum. Such existing mesh drums, characteristically having their surface area more than 50% open, have produced varied pressure differentials depending upon the length of the drums themselves and the size of the suction draft being employed.

SUMMARY OF THE INVENTION

Accordingly, it is a general purpose and object of the present invention to provide an improved sieve suction drum useful in textile processing for heat-treating of elongated web materials.

A more particular object of the present invention is to provide a sieve drum construction especially useful in suction drying of textile fabrics that maintains relatively high air permeability and uniform air distribution over its entire surface regardless of the length of the drum or the amount of suction draft to which it is exposed.

A further object is to provide a suction drum dryer that is faster and more energy efficient than previous drying systems and that without complicated structural supports, reliably produces a more uniformly dried web product than has heretofore been available.

A still further object of the present invention is to provide an improved sieve drum for heat setting specially treated fabric, particularly in the process of thermosol dyeing, that permits more effective and uniform heat transfer to the fabric for superior color fixation while minimizing wrinkles and other surface impressions in the fabric.

Briefly, these and other objects of the present invention are accomplished by a sieve drum, particularly useful in textile processing equipment, such as a suction drum dryer, for heat-treating of continuous web material. The sieve drum is constructed having a single layer of a close mesh screen cylindrically formed between a pair of end heads to provide support for and transmit torque to web material being processed. The close mesh screen is composed of a plurality of longitudinal and transverse wire lengths of relatively heavy gauge that are sinusoidally woven into a lattice having a multitude of small interstitial openings each with rounded edges to provide smooth, unabrasive support to the web material. The multitude of small openings the aggregate area of which comprises less than 50% of the screen surface provides an even distribution of heated air over the surface of the drum and exposes a high percentage of the supported web to the air for a fast, energy efficient heat-treating process.

For a better understanding of these and other aspects of the present invention, reference may be made to the following detailed description taken in conjunction with the drawing in which like reference numerals denote like parts throughout the respective figures.

DESCRIPTION OF THE PREFERRED EMBODIMENT

Figure 1:
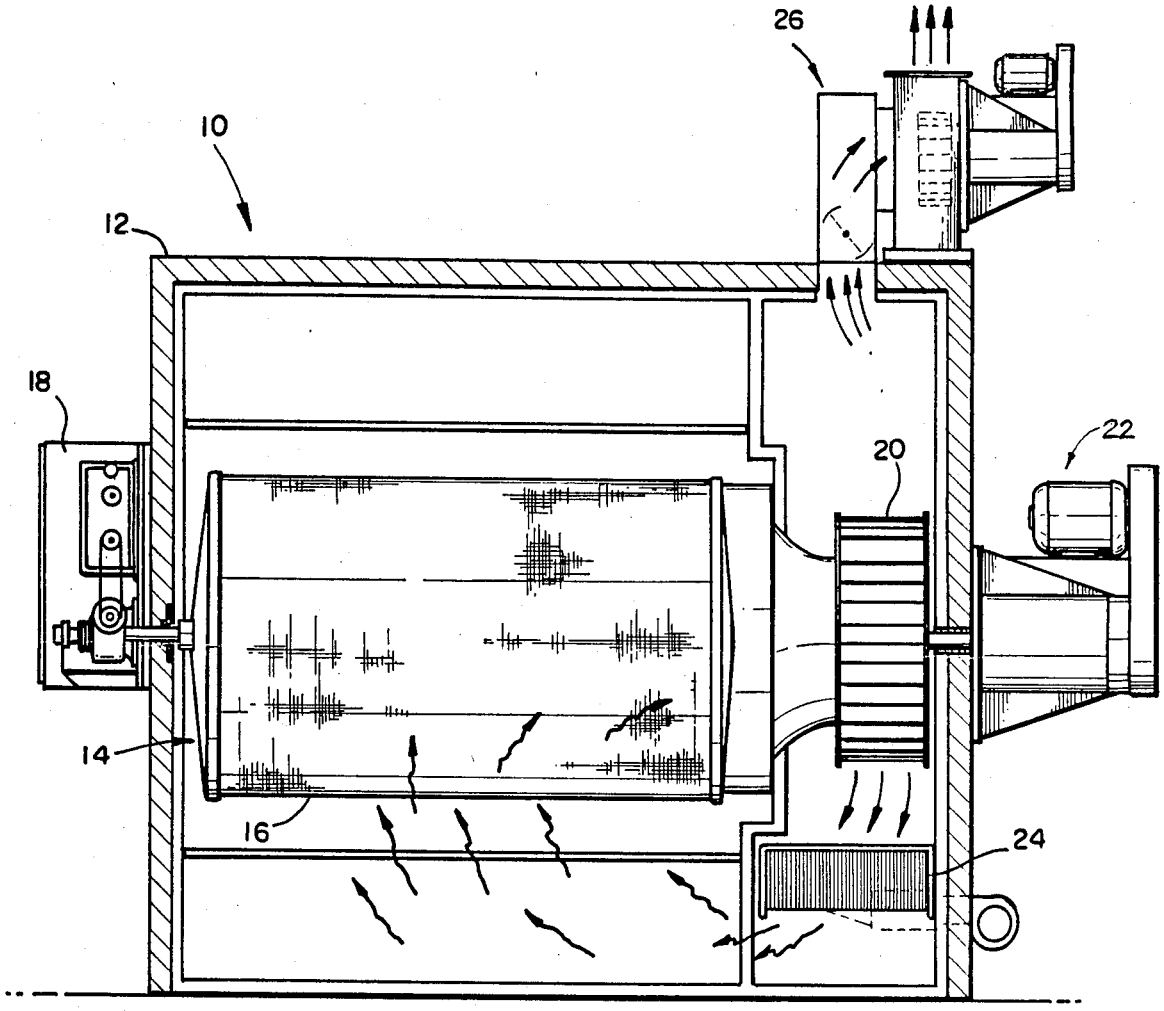
FIG. 1 is an axial view in partial cross section of a suction dryer incorporating a sieve drum according to the present invention.

Referring now to FIG. 1, there is shown a suction drum dryer, generally designated 10, which is useful in heat-treating elongated sheets of web material (not shown), such as knitted or woven fabrics. The dryer 10 is housed by an insulated enclosure 12 and incorporates a plurality of cylindrical sieve drums 14 (only one of which is shown) mounted in tandem for substantially parallel axial rotation. The sieve drums 14 are preferably grouped together in even multiples within the enclosure 12 so that the web material may be routed in a conventional manner into and through the enclosure over opposing sectors of adjacent tandem drums in a serpentine configuration.

In accordance with the present invention, each sieve drum 14 is constructed of a single layer of a close mesh screen 16 cylindrically formed and connected between a pair of substantially circular end heads 15, as described in greater detail hereinbelow with regard to FIGS. 2–5. Supported for rotation upon an axial shaft 28, better shown in FIG. 2, sieve drum 14 may be externally driven at one end thereof, either by a conventional variable-speed D.C. motor unit 18 mounted upon enclosure 12 and coupled to the axial shaft or by a separate line shaft drive (not shown) with adjustable controls for each pair of drums. A fan unit 20 mounted within enclosure 12 is driven by an external fan motor 22 and is coupled typically by ductwork to the opposite end of sieve drum 14 to create a partial vacuum within the interior of the drum thereby affecting the flow of air within the enclosure and causing a continuous suction draft of air through the drum, as indicated by the path of smooth arrows in FIG. 1. The fan 20 is preferably a centrifugal, backwardly inclined unit of conventional design, while the fan motor 22, also a conventional unit, may typically incorporate adjustable bases, V-belt drives and associated drive guards.

A heater unit 24 of a standard type that utilizes steam, gas or thermal fluid in its operation is mounted within enclosure 12 in proximity to the fan unit 20 to receive the air therefrom drawn from the interior of sieve drum 14. The heater unit 24 thus operates upon the drawn air received from the fan unit 20 to circulate and return heated air back to the sieve drum 14 for drying as shown by the path of irregular arrows in FIG. 1. An automatic exhaust unit 26 may be mounted upon the enclosure 12 to control ventilation of the enclosure and thus adjust the volume of air flow within the dryer 10. Alternatively, manually set dampers may be used to control exhaust volume with suction draft flow rates being typically in the range of 2,000–6,000 feet per minute.

Figure 2:
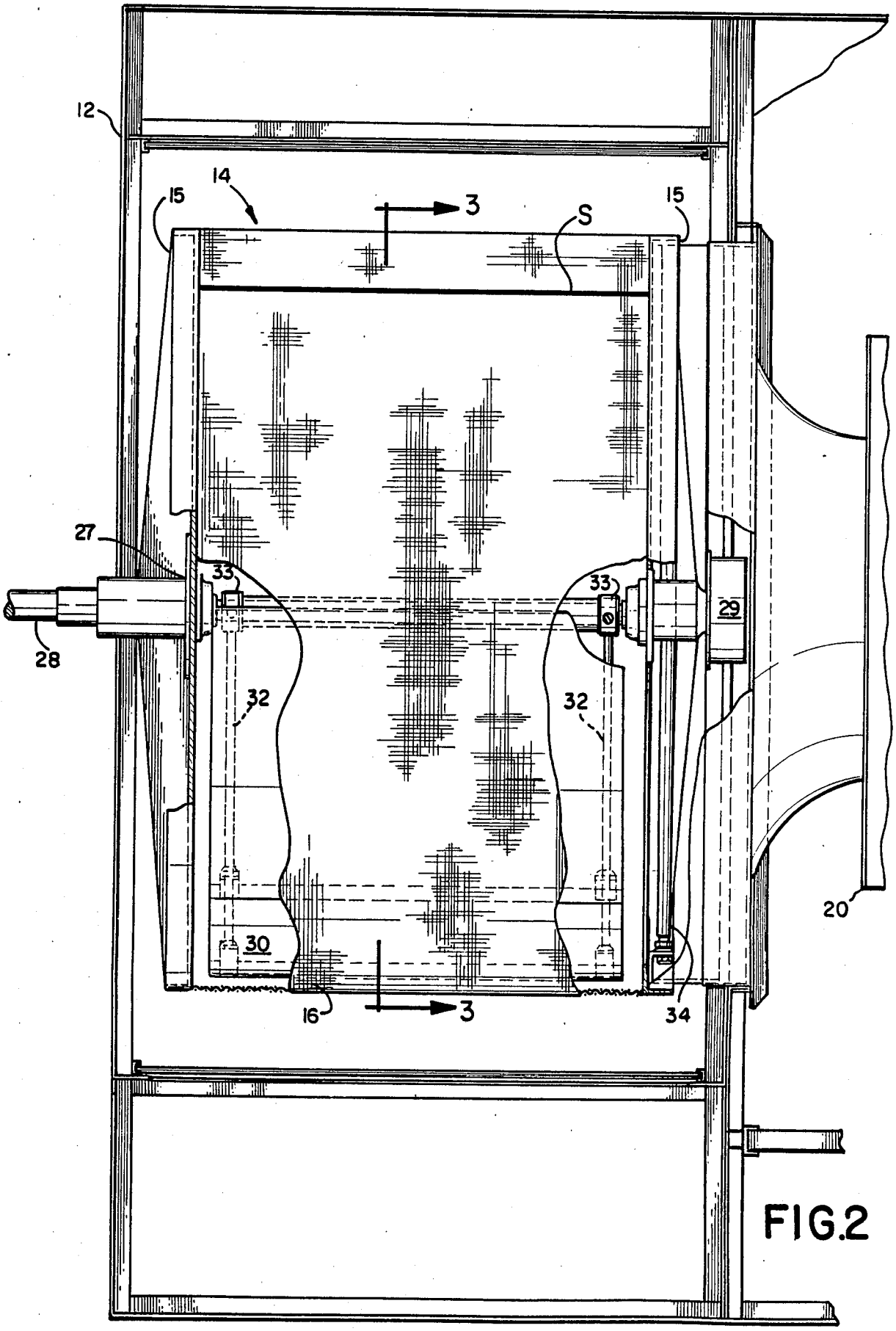
FIG. 2 is an enlarged axial view of the sieve drum of the present invention with partial cross sections to show its rotational mounting.
Figure 3:
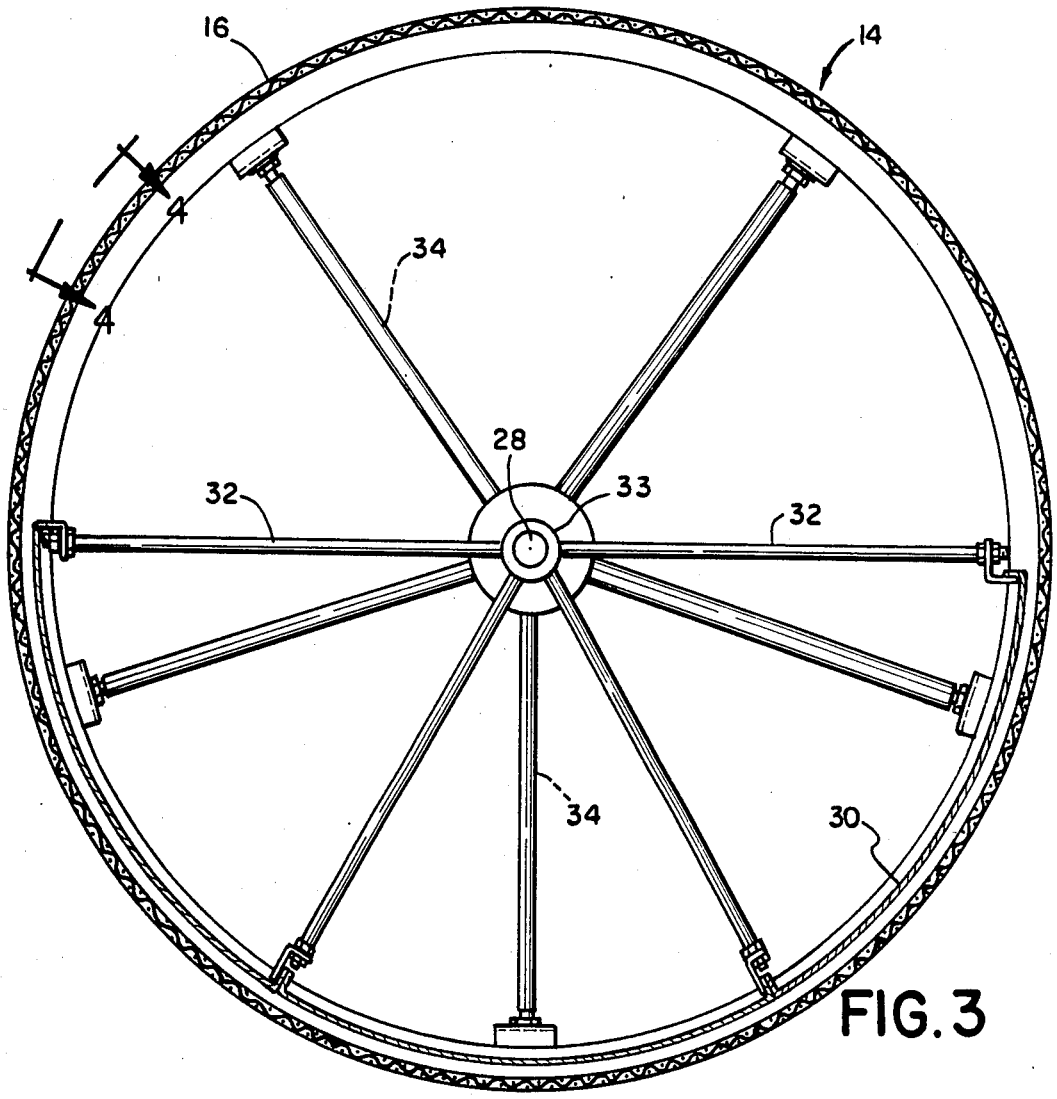
FIG. 3 is a cross section of the drum shown in FIG. 2 taken along the line 3—3 showing more clearly the screen mesh and internal baffles associated with the present invention.

Referring now to FIGS. 2 and 3 in conjunction with FIG. 1, the axial shaft 28 extends from its connection with drive unit 18 through sieve drum 14, coaxially engaging a rotational hub member 27 centrally secured to the end head 15 nearer the drive unit and rotatably coupled to the corresponding side of enclosure 12. The opposite end of axial shaft 28 coaxially engages the far end head 15 which is, in turn, rotably coupled to the enclosure 12 via a bearing mount 29 installed within an adjacent wall thereof. A plurality of support struts 34 radially extending from bearing mount 29 are attached about the perimeter of the adjacent end head 15 to lend structural support to drum 14 in rotation.

Within each sieve drum 14, a curved baffle 30 is mounted so that it is maintained in immediate proximity to the interior surface of the close mesh screen 16 covering a sector thereof. The covered sector, typically 180° of the interior of drum 14, represents that portion of the close mesh screen 16 intended to be free from the web material being processed. The baffle 30 thus functions to interrupt the suction draft along and through that sector free of the web focusing the directional flow of heated air through the unbaffled sector and, accordingly, through the web supported thereon. The baffle 30 is fabricated of rigid plate material shaped to conform to the internal radius of the close mesh screen 16 and may comprise a series of separate baffle sections joined together to cover the required interior portion of the screen. A plurality of rigid support rods 32 connected to each side of the baffle 30 at symmetrical points along its radius are used to maintain the proper radial position of the baffle. The support rods 32, in conjunction with a pair of hubs 33 rigidly secured along axial shaft 28 on either side of the interior of the drum 14, combine to maintain the proper stationary position of the baffle 30 in immediate proximity to the close mesh screen 16.

Figure 4:
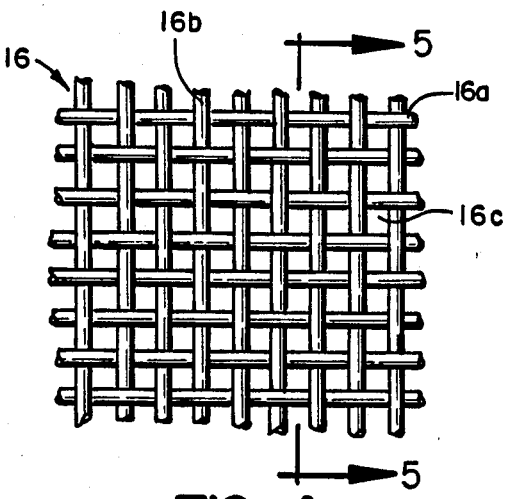
FIG. 4 is a greatly enlarged radial view of a portion of the drum taken along the line 4—4.
Figure 5:
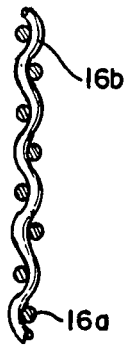
FIG. 5 is a cross section of the screen mesh shown in FIG. 4 taken along the line 5—5 to show the structure and pattern of the mesh.

Referring now to FIGS. 4 and 5 in conjunction with FIG. 3, the close mesh screen 16 is composed of a respective plurality of longitudinal and transverse wire lengths **16*a* and 16*b* which are woven together into a substantially perpendicular lattice, as best shown in FIG. 4. The wire lengths 16*a* and 16*b*** are fabricated from an oval or rounded wire that is particularly strong and corrosion resistant, such as stainless steel, with such wire being of a relatively heavy gauge, preferably in the range of 0.105–0.135 inch diameter so that a rigid supporting surface is produced.

As best shown in FIG. 5, the wire lengths **16*a* and 16*b* are woven together in a sinusoidal fashion to form the lattice. A multitude of small interstitial openings 16*c*, shown more clearly in FIG. 4, are thus produced each with rounded edges to support the web material and permit the smooth flow of air therethrough. The interstitial openings 16*c* are closely formed within the mesh screen 16 with the aggregate area of the openings comprising less than 50% of the drum surface to restrict the flow of air radially therethrough and thereby promote uniformity of flow rates across the entire length of drum 14. Preferably, the aggregate area of the interstitial openings 16*c* is less than 30% of the total surface area of screen 16 and can be accomplished by interweaving the respective longitudinal and transverse wire lengths 16***a* and 16*b* in a lattice pattern of 4–5 wires per inch. With the rounded edges of the interstitial openings 16*c* serving to support the sheet of web material, such a woven mesh pattern of the wire lengths 16*a* and 16*b* will expose as much as 85–90% of the web material to a smooth flow of heated air suctioned through the drum 14.

The close mesh screen 16 so described is formed into a rigid, self-supporting cylinder and is joined at a fully welded longitudinal seam S extending between the end heads 15. For an extended width of the close mesh screen 16 used to construct a longer drum 14, usually greater than 40 inches, additional welding may be required across the surface of the screen to maintain its rigid, self-supporting character. Formed to have substantially the same diameter as the end heads 15, the close mesh screen 16 is attached at each end thereof to the respective perimeters of the end heads with the perimeter attachment being effected by conventional welding. In its self-supporting form, the foregoing close mesh screen 16 thus provides a high-capacity and even flow of the heated air through the supported web material without any interference to the effective blocking operation of the internal baffle 30.

It should be further noted that the foregoing sieve drum 14 with its self-supporting close mesh screen 16 may be effectively employed to offer improved heat-transfer performance in textile processing systems other than the suction drum dryer 10 shown in the drawing figures. For example, a plurality of the sieve drums 14 may be used in the well known process of thermosol dyeing to support and convey synthetic and blended fabrics that are treated with dyestuff and moved through controlled ovens. Supported upon the rounded edges of the multiplicity of interstitial openings 16*c*, a substantial surface portion of the treated fabric is exposed to a smooth and direct flow of heated air through the close mesh screen 16 for optimum heat-transfer. As a result, more rapid and uniform heating-up of the treated fabric occurs in the thermosol ovens providing a greater exploitation of the dyestuff and a superior color fixation.

Therefore, it is apparent that the disclosed invention provides an improved sieve drum useful in textile processing for heat-treating of elongated sheets of web materials, particularly providing a drum construction for suction drying of textile fabrics that maintains relatively high air permeability and uniform air distribution over its entire surface regardless of the length of the drum or the amount of suction draft to which it is exposed. Furthermore, the disclosed sieve drum provides a suction drum dryer that is faster and more energy efficient than previous drying systems and that, without complicated structural supports, reliably produces a more uniformly dried web product than has heretofore been available. In addition, use of the described drum improves the heat-setting of specially treated fabrics, particularly in the process of thermosol dyeing, producing more effective and uniform heat transfer to the fabric surface for superior color fixation while minimizing wrinkles and other surface impressions.

Obviously, other embodiments and modifications of the present invention will readily come to those of ordinary skill in the art having the benefit of the teachings presented in the foregoing description and drawings. It is therefore to be understood that various changes in the details, materials, steps, and arrangement of parts, which have been described and illustrated to explain the nature of the invention, may be made by those skilled in the art within the principle and scope of the invention as expressed in the appended claims.

I claim:

1. A sieve drum for heat treating a web material comprising:

a drum surface made exclusively of a close mesh screen cylindrically shaped and self-supporting for conveying the web material upon said screen under rotation, said screen comprising a plurality of longitudinal and transverse wire lengths of a relatively heavy gauge interwoven in a sinusoidal fashion to form a multitude of interstitial openings each with rounded edges, the aggregate area of said openings being less than 50% of the surface of said screen; and a pair of circular heads attached to either end of said screen.

2. The sieve drum according to claim 1, wherein the aggregate area of said interstitial openings is less than 30% of the surface of said screen.

3. The sieve drum according to claim 2, wherein:

said plurality of longitudinal and transverse wire lengths are interwoven at a density of 4–5 wire lengths per inch.

4. An apparatus for drying a continuous sheet of a web material, comprising:

an insulated enclosure;

at least one sieve drum axially mounted within said enclosure, the surface of said drum being constructed exclusively of a close mesh screen cylindrically shaped and self-supporting for conveying the web material upon the surface of said screen under rotation, said screen comprising a plurality of longitudinal and transverse wire lengths of a relatively heavy gauge interwoven in a sinusoidal fashion to form a multitude of interstitial openings each with rounded edges to support and convey the web material, the aggregate area of said openings being less that 50% of the surface area of said screen;

drive means for axially rotating said drum;

fan means coupled to said drum for creating a partial vacuum therein so that air is drawn into said drum; and heater means mounted within said enclosure for heating the air drawn into said drum.

5. A drying apparatus according to claim 4, further comprising:

baffle means mounted within said drum in immediate proximity to the interior surface of said screen along a sector thereof for blocking the flow of air into said drum along said sector.

6. A drying apparatus according to claim 4, wherein said drum further comprises:

a pair of circular heads attached to either end of said screen.

7. A drying apparatus according to claim 4, wherein the aggregate area of said interstitial openings is less than 30% of the surface of said screen.

8. A drying apparatus according to claim 7, wherein;

said plurality of longitidinal and transverse wire lengths are interwoven at a density of 4–5 wire lengths per inch.

9. In a textile processing system of the type wherein a continuous sheet of fabric treated with a dyestuff is conveyed through controlled temperature conditions to effect dyeing of the fabric, the improvement comprising:

at least one sieve drum mounted for axial rotation to convey the fabric through the controlled temperature conditions, the surface of said drum being constructed exclusively of a close mesh screen cylindrically shaped and self-supporting for conveying the fabric thereon under rotation, said screen comprising a plurality of longitudinal and transverse wire length of a relatively heavy gauge interwoven in a sinusoidal fashion to form a multitude of interstitial openings each with rounded edges to support the fabric, the aggregate area of said openings being less than 50% of the surface area of said screen.

10. The improvement according to claim 9, wherein said drum further comprises:

a pair of circular heads attached to either end of said screen.

11. The improvement according to claim 9, wherein the aggregate area of said interstitial openings is less than 30% of the surface of said screen.

12. The improvement according to claim 11, wherein:

said plurality of longitudinal and transverse wire lengths are interwoven at a density of 4–5 wire lengths per inch.

* * * * *